US006446412B2

(12) United States Patent
Mathis

(10) Patent No.: US 6,446,412 B2
(45) Date of Patent: Sep. 10, 2002

(54) GLULAM WOOD BEAMS AND METHOD OF MAKING SAME

(75) Inventor: Paul-Henri Mathis, Muttersholtz (FR)

(73) Assignee: Mathis Tech Inc., Jonquiere (CA)

( * ) Notice: Subject to any disclaimer, the term of this patent is extended or adjusted under 35 U.S.C. 154(b) by 13 days.

(21) Appl. No.: 09/769,747

(22) Filed: Jan. 26, 2001

(30) Foreign Application Priority Data

Jan. 27, 2000 (CA) ..... 2297556

(51) Int. Cl.[7] ..... E04C 3/12

(52) U.S. Cl. ..... 52/730.7; 52/731.2; 52/732.1; 52/729.4; 52/745.19; 144/345; 144/378

(58) Field of Search ..... 52/730.7, 731.2, 52/732.1, 729.4, 745.19; 144/345, 378, 335, 346, 352, 367

(56) References Cited

U.S. PATENT DOCUMENTS

| | | | | |
|---|---|---|---|---|
| 3,041,231 A | * | 6/1962 | Fountain | 144/330 X |
| 5,115,609 A | * | 5/1992 | Sing | 52/730.7 X |
| 5,618,371 A | | 4/1997 | Sing | |
| 5,865,002 A | * | 2/1999 | Tapojarvi et al. | 52/730.7 X |
| 5,865,929 A | | 2/1999 | Sing | |
| 5,888,620 A | | 3/1999 | Grenier | |
| 5,896,723 A | | 4/1999 | Sing | |
| 6,025,053 A | | 2/2000 | Grenier | |
| 6,279,629 B1 | * | 8/2001 | Sing | 52/730.7 X |
| 6,358,352 B1 | * | 3/2002 | Schmidt | 144/345 X |

FOREIGN PATENT DOCUMENTS

| | | | |
|---|---|---|---|
| CA | 2225350 | | 1/1997 |
| CA | 2267902 | | 4/1998 |
| CA | 2272465 | | 5/1998 |
| CA | 2194793 | | 7/1998 |
| CA | 2238491 | | 11/1999 |
| EP | 0 388 507 | * | 9/1990 |
| WO | WO 00/45006 | * | 8/2000 |

* cited by examiner

*Primary Examiner*—Laura A. Callo
(74) *Attorney, Agent, or Firm*—Browdy and Neimark

(57) ABSTRACT

There is provided a glulam wood beam comprising planks having a width substantially smaller than the width of the beam, assembled into snips. The beam is characterized by the presence of flash in the interior by external surfaces made essentially of duramen. There is further provided a method for making the wood beam of the instant invention wherein the strips are derived from panels and in which the cutting of the panels into strips is programmed to ensure that the subsequent assembly of the strips will result in beams having external surfaces comprised essentially of duramen, thus providing a beam with enhanced mechanical resistance.

30 Claims, 6 Drawing Sheets

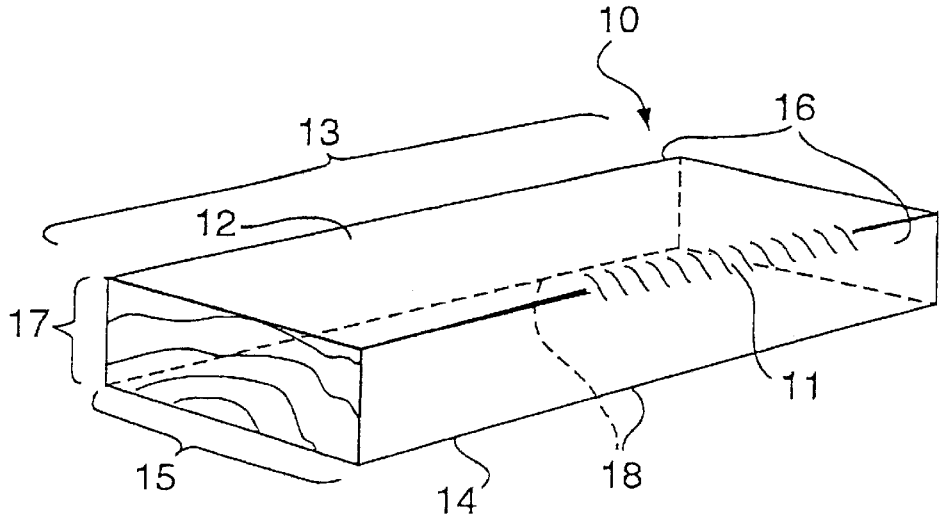
FIG. 1
FIG. 2
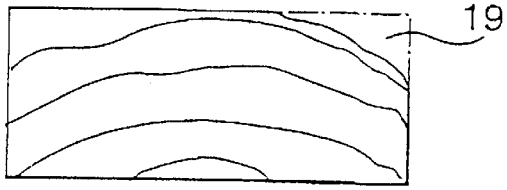
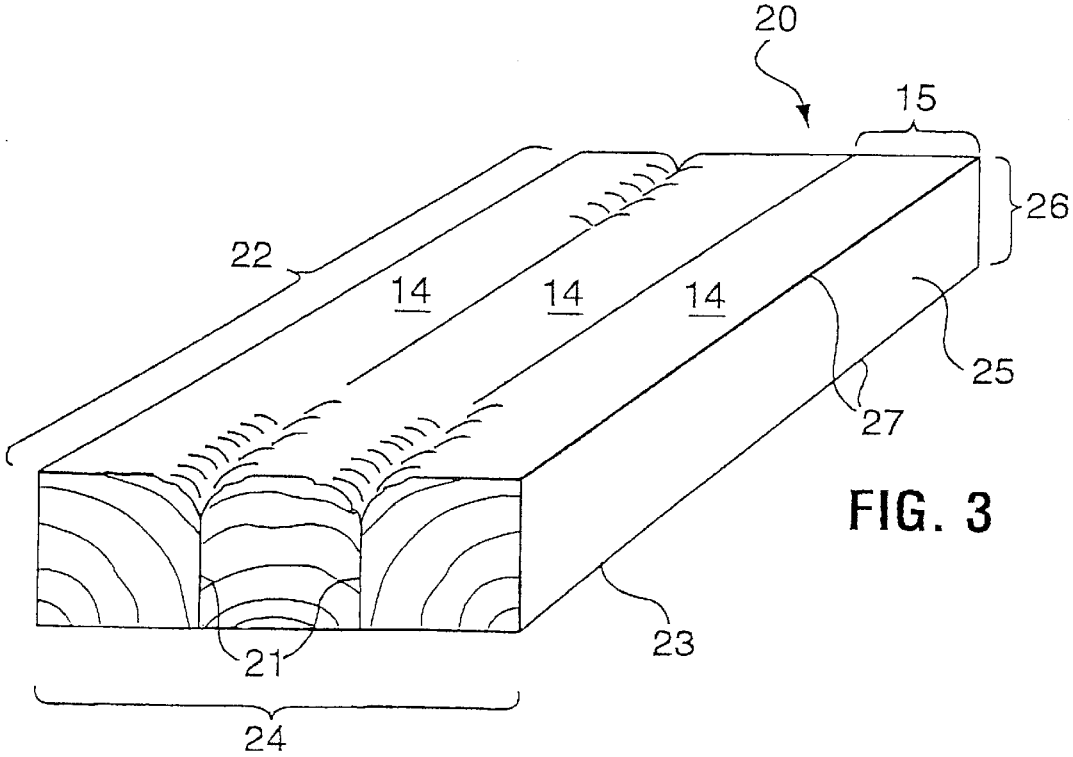
FIG. 3

GLULAM WOOD BEAMS AND METHOD OF MAKING SAME

BACKGROUND OF THE INVENTION

Conventional, glulam wood beams manufacturing are usually manufactured with perfectly squared wood planks corresponding to the width of the desired beam less the wood necessary to plane down the beam so as to obtain perfectly smooth surfaces, The planing down step is often necessary in view of the fact that the glulam beams can be used as decorating elements as well as structural elements. This double use of glulam beans requires that the surface be exempt of any defects such as the presence of flash on the planks.

On the other hand, an optimum exploitation of forest resources requires that saw mills exact as much squad planks as possible. This objective is particularly difficult to reach when the trees are of small diameter. In this case, the proportion of planks with bark can be important since the diameter of the tree is sometimes insufficient to provide planks of standard dimensions to produce perfectly squared surfaces. However, this type of tree with small trunk diameter, constitutes an important stock of resources of coniferous trees in the subpolar circle in the northern hemisphere. The mechanical resistance of this type of wood is however very good due to the slow growth of the trees which produces a width of high densities and furthermore, is type of wood usually is devoided of large timber knots which can comprimise the mechanical resistance.

Furthermore, the planks with greater width generally used in the preparation of glulam wood beams are made with trunks exhibiting large diameter and they have the tendency to change shape upon drying. This property renders the glueing of the planks difficult. This property renders the glueing of the plank difficult by eating tensions within the beams.

Due to the difficulty to extract planks of sufficient width and exempt of a flash, the above mentioned northern forest resource has been neglected up to now for the manufacturing of plank for the use in glulam wood beams.

The instant invention overcomes the limitation of the prior art by providing a beam and a method of making beams using plank obtained from trees having small trunk diameters.

SUMMARY OF THE INVENTION

The instant instant invention provides a wood beam composed of rectangular strips, said strips comprising planks of identical length and having a width substantially smaller than the desired width of the beam, said beam being characterized by the presence of two strips forming the top and the bottom of said beam and a central part comprising either planks or strips, said beam being further characterized by the presence of flash in the interior and by the top, bottom and sides external surfaces being essentially plane.

In an other embodiment there is further provided wood beam composed of rectangular strips, said strips comprising planks of identical length and having a width substantially smaller than the desired width of the beam, said plank being characterized by having two longitudinal plane surfaces substantially parallel constituting the top and the bottom of said plank and having two longitudinal plane surfaces constituting the sides of said planks, the sides being substantially perpendicular to the top surface and the bottom surface, the bottom surface intersecting at a right angle each of the two sides, the top surface being linked to the sides by intersecting said sides at right angles or by the natural curvature of the from which the plank is obtained thus forming flash, said strips being formed by two or more planks adhered by their sides thus forming lateral joints and in such a way that the bottom of the planks form a uniform plane surface and that the sides of the two planks at the lateral ends of the strips, non adjacent to another plank, intersect the top surface and the bottom surface at a right angle, the beam being formed by the assembly and reciprocal adherence of the strips, said beam being characterized by the presence in its interior of planks at least some of which exhibiting flash, said beam being also characterized by a top and a bottom each composed by a strip the bottom of which constituting the exterior of the beam, the strips included between the top strip and the bottom strip forming a central part, said beam being also characterized by two sides having a plane surface perpendicular to the top and bottom of the beam.

The instant invention either provides a method for making the beam according said method comprising the steps of: obtaining planks having two longitudinal plane surfaces substantially parallel constituting the top and the bottom of said planks and having two longitudinal plane surfaces constituting the sides of said planks, the sides being substantially perpendicular to the top and the bottom surface, the bottom surface making a right angle with each of the two sides, the top surface being linked to the sides by either a right angle or the natural curvature of the trunk from which the plank is obtained thus forming flash; drying the planks to obtain a hydrometric degree compatible with the application of art adhesive; sorting the planks to eliminate those that do not conform with pre-established selection criteria selected from general geometry, absence of timber knots effecting the mechanical resistance of the planks and mechanical resistance properties; treating the sides of the planks to optimize the efficiency of a selected adhesive; selecting the planks sorted according to their width to assemble the strips having a length corresponding to the desired length of the beam; applying the adhesive on said sides of the planks and placing the planks side by side in such a way that the sides are in reciprocal contact and that the bottom of the planks form a plane surface to constitute strips having a width equal to or greater than the desired width of the beam and applying a lateral pressure to optimize adhesion of the plank; joining the strips by their ends to form finger joints; applying an adhesive on the top surface of the strips; and assembling the strips to form a beam having the desired dimensions and applying pressure to optimize the adhesion of she strips.

There is further provided a method in which the planks in the strips differ in their width and are assembled in panels according to a repetitive pattern relative to their width, said panels being cut along the longitudinal axis of the planks to obtain strips of desired width, the cutting being made such that the sides of the strips intersect the bottom and top surfaces of said planks at a right angle and that said sides are constituted essentially of the duramen of the wood.

BRIEF DESCRIPTION OF THE DRAWINGS

These and other features of the invention will become more apparent from the following description in which reference is made to the appended drawings wherein:

FIG. 1 is a perspective view of a plank used in the instant invention for the making of glulam beams;

FIG. 2 is a sectional view of the plank of FIG. 1 showing the presence of a flash;

FIG. 3 is a perspective view of a strip of the instant invention;

DETAILED DESCRIPTION OF THE INVENTION

Figure 4:
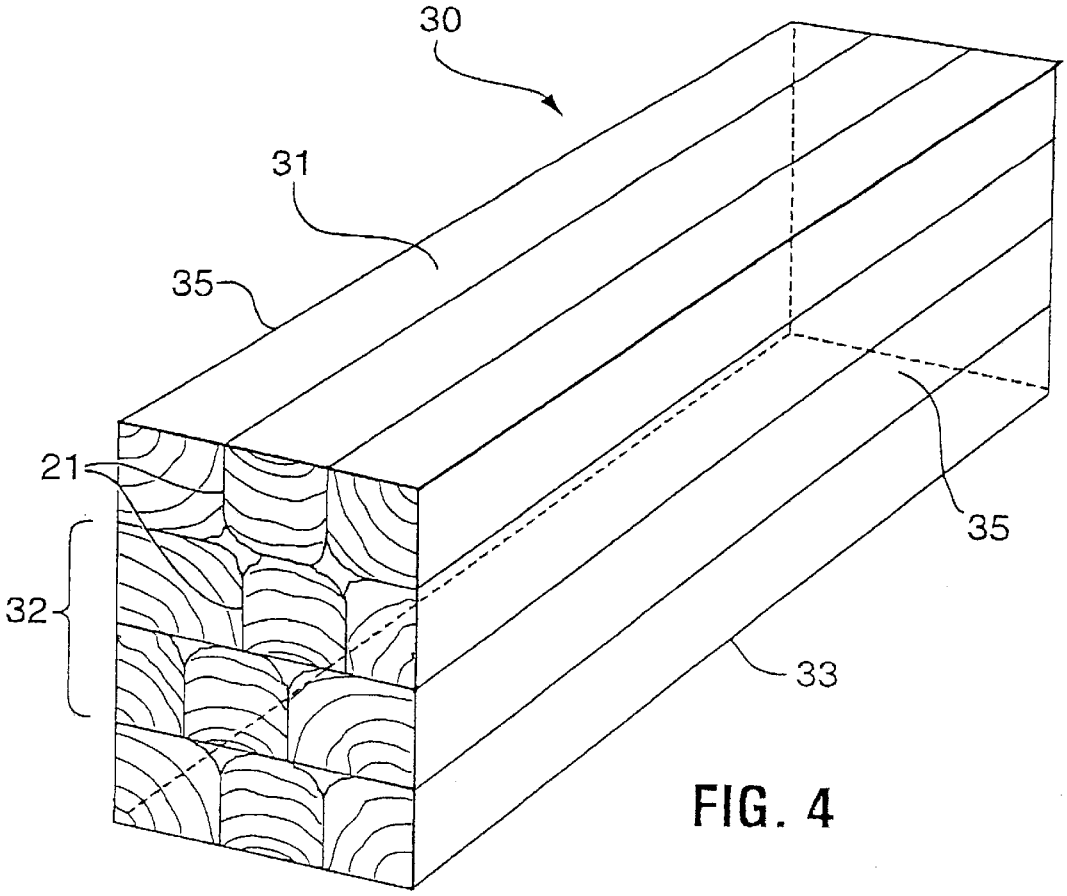
FIG. 4 is a perspective view of a beam of the instant invention.

The wood beam of the instant invention is characterized in that it is formed with strips. These strips are in turn constituted from an assembly of planks. The planks, of which an example 10 is illustrated in FIG. 1, exhibit two longitudinal plane surfaces substantially parallel constituting tie top 12 and the bottom 14 and two longitudinal plane surfaces constituting the sides 16. The planks are also characterized by a length 13, a width 15 and a thickness 17. The width of a given plank is not necessarily uniform at all points along the length but may vary slightly. This variation is due to the natural decrease in trunk diameter from which the plank is obtained. This variation of the width is acceptable for the manufacturing of the wood beams of the instant invention. The sides of the planks are substantially perpendicular to the top surface and the bottom surface and they intersect the bottom at a right angle (90°), thus forming two sharp edges 18. The top surface is linked to the sides by either a right angle to form a sharp edge, or by a curved surface corresponding to the natural curvature of the trunk as indicated at 11.

The presence of a curved surface linking the top surface to one of the sides may be defined as an empty volume of wood when compared to a plank exhibiting four sharp edges. This volume 19 is defined by the space included between the curved surface of the trunk and the imaginary extension of the side and of the top surface (FIG. 2). This empty volume, in the instant description, is referred to as flash. Flash may be due, for example, to the sawing of a trunk with a diameter insufficient to provide planks of a given thickness and of a given width exhibiting four sharp edges along the entire plank length (perfectly squared plank).

One of the important aspects of the invention is to provide a glulam wood beam and a method of making the same, allowing the use of planks exhibiting flash and consequently permitting the use of trees having small diameter trunks. This aspect not only allows the exploitation of a neglected forest resource in the manufacturing of glulam but it also allows a significant increase in the yield of gross product/finish product. The beam, despite the presence of flash, exhibits mechanical properties that conform to the standards in the construction industry.

Due to the presence of flash, the thickness of the planks is not necessarily uniform. The thickness of a plank in the present description will be defined by the thickness measured between the top plane surface and the bottom plane surface.

The thickness and the width (Thickness×width) of the planks used in the manufacturing of the beams of the instant invention vary and are preferably, without being limited to these dimensions, two inches by two inches (2"×2"), two inches by three inches (2"×3"), two inches by four inches (2"×4") and two inches by six inches (2"×6"). Similarly, the lengths will be, without being limited to these values, preferably between six feet (6') and 20 feet (20').

The present invention thus allows the manufacturing of a wood beam with desired dimensions using planks containing flash and having width substantially smaller than the desired width of the wood beam.

The strips 20 (FIG. 3) of the woodbeam comprise planks of identical length and thickness, but which may have different width, assembled by their sides to form lateral joints 21 so that the bottom surface 23 of the strip is plane and constituted by the bottom surface of the planks 14. The strips are characterized by a length 22 corresponding to the length of the planks, a thickness 26 corresponding to the thickness of the planks and a width 24 corresponding to the sum of the width 15 and of the planks 14.

The sides 25 of the strips are formed by the sides of the planks that are not adjacent to other planks and positioned at the lateral ends of the strips. The sides of the strips intersect the bottom surface and the top surface of the plank at a right angle, thus forming two sharp edges 27.

A frequently encountered problem in the manufacturing of glulam beams using planks having width substantially similar to the width of the beam is that the planks when dried, have a tendency to change shape due to the non uniform shortening of wood fibres. This deformation often results in the "curving" of the plank and is usually more pronounced for planks of greater dimensions. This deformation is not desirable since it generates tensions that can be strong enough to cause the rupture of the joints within the strips and the beam. Advantageously, the instant invention considerably reduces this effect by using planks having widths substantially smaller than the width of the beam. Furthermore, the presence of flash in lateral joints provides tension breaking points within the strips contributing to the stabilization of the beam.

In a further aspect of the instant invention, the wood beam 30 (FIG. 4) is constituted by strips 20 horizontally superimposed and adhered together to obtain a wood beam of a desired thickness. The arrangement of the strips within the beam is such that the lateral joints 21 of two adjacent strips are perceptibly out of line. This non alignment of the lateral joints confers mechanical properties to the beam that are equal or greater than the norms established by the construction industry. The two strips bordering the thickness of the beam form the top 31 and the bottom 33 of the beam and are placed in such away at the bottom of the strip forms the external surface of the beam and ensures that this surface is plane and devoided of flash. The strips included between the top and bottom strips form a central pant 32 of the beam. The sides of the beam 35 are constituted by the sides of the strips to form a substantially plane surface. Once the beam is assembled, the surfaces are planed in order to obtain an essentially plane surface and to reduce the width of the beam to the desired width. The ends of the beam may comprise flash.

The strips may also be assembled according to different models. Some of these non liming examples are described in Example 3 below.

Figure 5A:
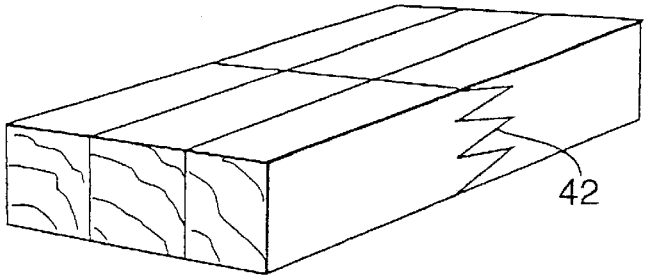
FIG. 5 is a perspective view of two types of finger joints.
Figure 5B:
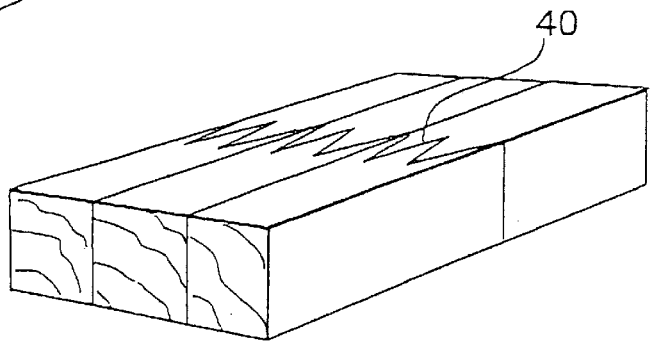

According to yet another aspect of the instant invention, the strips may be joined by their ends (finger joints) to obtain strips of desired length. FIG. 5 illustrates two types of jointing that can be used: face jointing 40 and flat jointing 42. Although the examples used herein to illustrate the invention are described with face jointing, other types of finger joint, as would be obvious to one skilled in the art, are also considered to be part of the invention.

Figure 6:
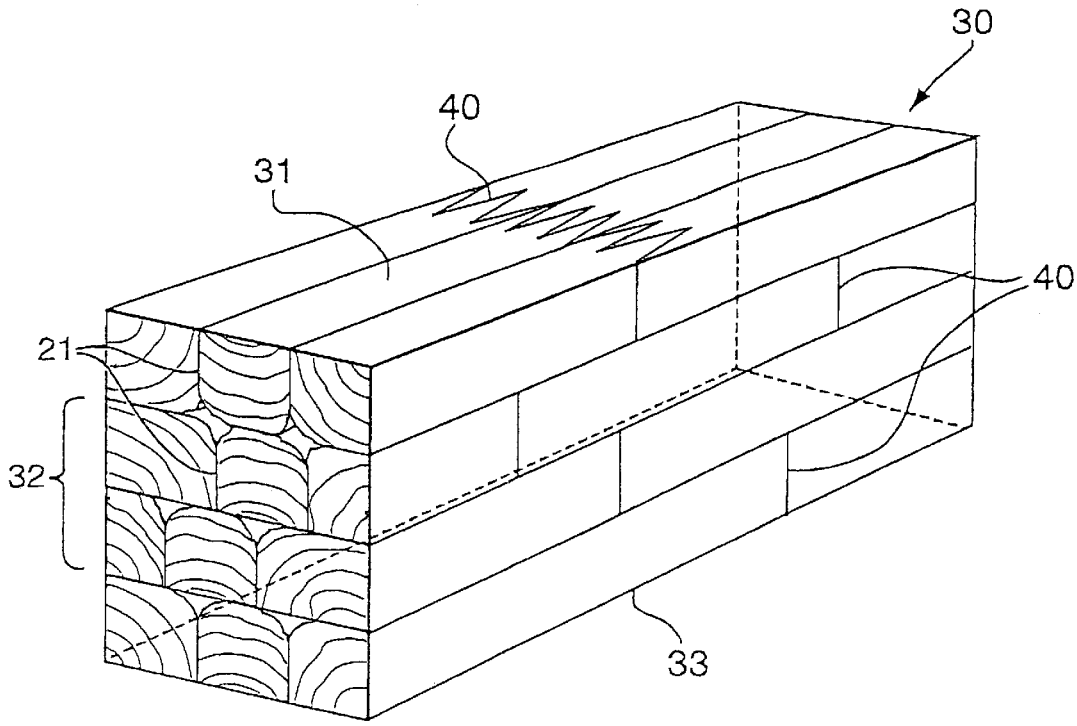
FIG. 6 is a perspective view of a wood beam comprising out of line finger joints.

The strips thus jointed are assembled into beams as described above in such away that the finger joints of two adjacent strips in the beam are out of line. This arrangement may be visualized by referring to FIG. 6 in which out of line finger joints 40 are illustrated.

The beam of the instant invention may be manufactured with any type of wood compatible with the norms of the industry. However, in a preferred embodiment of the instant invention the wood is obtained from coniferous species that can be found in the region of the sub polar crown of the northern hemisphere which have a slow growth and a relatively small diameter. Among the different type of trees from this region, the black spruce is preferred for the man manufacturing of the beam of the instant invention. In a preferred embodiment, the external surfaces of the beam are essentially made of wood fibers located near the centre of the trunk called duramen.

The instant invention also provides a method for making the beams described above which will now be described.

The first step consists of obtaining planks originating from tree trunks having small diameters, preferably the black spruce, but other species of trees may also be used as long as their mechanical properties are compatible with the norms, and which may comprise flash.

In the second step, the planks are dried to obtain planks with an hygrometric degree compatible with the adhesive used in the manufacturing of glulam wood beams. This hygrometric degree can vary between 8 and 12% but may be modified as would be obvious to one skilled in the art to obtain physical properties that are optimal for the adhesion and for the resistance of the wood.

After the drying step, the planks are sorted on the basis of pre-established criteria that are well known to persons skilled in the art. These criteria include, but are not limited to: the general geometry, absence of visual flaws (colouration, insect bites, decay, chips, cracks), the absence of timber knots at the ends of the planks, the classification of the mechanical resistance according to tolerance criteria. In particular, the sorting allows the elimination of planks having timber knots that interfere with the alignment of wood fibers. These knots can reduce the mechanical resistance of the planks. The discarded planks are recycled to be used in other wood products in which their presence may be acceptable thus reducing wastes to a minimum. This elimination of the planks having compromising timber knots is an important element of the instant application since traditionally, in the manufacturing of glulam beams; these planks are "repaired" by cutting out the knots from the planks and by then joining the two sections of the planks thus generated by a finger joint. This method is time consuming and expensive and in addition introduces flaws in the planks that may lower their mechanical resistance. Advantageously, the present invention preferably uses tree species generally exhibiting small timber knots that do not compromise the mechanical resistance of the planks.

With regard to the instant invention, the planks are classified in two categories of resistance: superior resistance and adequate resistance. The mechanical properties of the planks of these two categories meet the norms of the construction industry. This classification allows the planks to be located in the beam at critical positions to optimize its mechanical properties. It will be appreciated that the classification of the planks in more than two categories, without departing from the scope of the instant invention, is also possible.

The sides of the planks thus sorted are treated to optimize the adhesion surface that will be involved in the assembly of the strips. This treatment may include, but is not limited to planing.

The next step consists in the selection of planks that will be included in the strips. The planks, which may be of different width, are selected to obtain a combination of planks which will produce, once assembled, a strip of the desired width. It will be appreciated that the width may be slightly greater an the desired width of the beam. This slight excess in width allows the beam to be assembled with imperfectly aligned sides which will subsequently be planed to produce a smooth surface and to reduce the width of the beam to the desired width. The selection also ensures that the sides of the strips do not comprise any flash. This selection results in an optimal use of the plank stock.

Once the selection of the planks has been completed, an adhesive is applied on the sides of the plank, except the sides that are located at the lateral ends of the strips. The planks are then placed side by side in such a way that the sides are in contact with each other and that the bottom of the planks form a plane surface and that the length of the strip is uniform. The strips are then submitted to a lateral pressure of an adequate duration to optimize the reciprocal adherence of the sides.

The strips are then jointed by their ends using flat or face jointing or any other type of joints as would be obvious to one skilled in the art.

An adhesive is then applied to the top surface of the planks and the strips are assembled to form the beam. The strips are ranged within the beam in such a manner as to ensure that the finger joints are substantially out of line relative to one another. The beam will then be enclosed in a press to optimize the reciprocal adhesion of the strips.

The glueing of the strips is a conventional glulam glueing using straight or curved presses that can be either vertical or horizontal, with or without heat and with or without high frequencies or microwaves.

Finally, the beam is planed to smooth all surfaces and to reduce the length, the thickness and the width to the desired dimensions.

The top and the bottom of the beam are the most mechanically solicitated part of the beam. Advantageously, the method of the present invention allows the composition of the beam to be programmed so that the planks which exhibit adequate resistance properties be included in the central part of the beam and that the planks exhibiting superior resistance properties be included in the strips forming the top and the bottom of the beam.

According to yet another aspect of the method of the instant invention, the planks are selected and assembled in panels. These panels are subsequently cut in strips of the desired width in such a way that the sides of the strips are essentially made of wood fibers that are located essentially in the duramen.

Figure 7A:
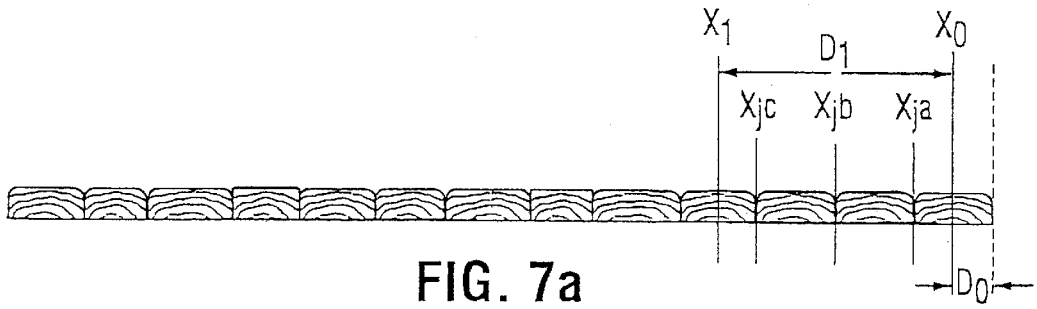
FIG. 7 is a side view of a panel used in the manufacturing of strips.
Figure 7B:
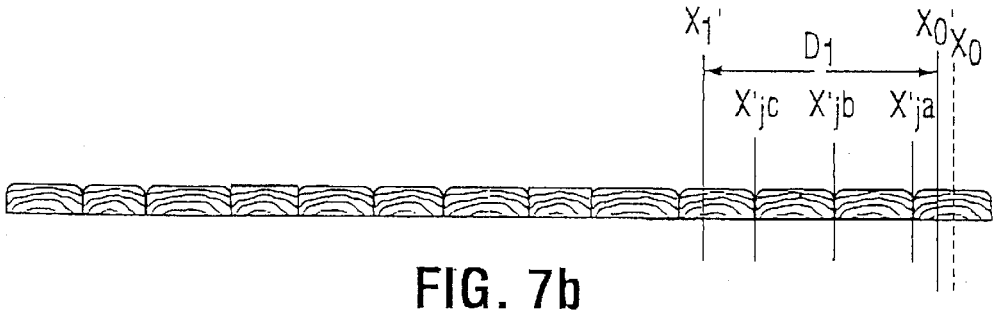

The cutting of the panels into strips will now be described referring to FIG. 7. Panel 60 is constituted of plans, which may exhibit differing width, adhesively assembled by their sides and arranged according to a repetitive pattern relative to their width (Example: 1×2"×4", 2×2"×3", 1×2"×4", 2×2"×3", etc.). The first plank of the panel is cut at a position $X_O$ located at a distance $D_O$ from its side, substantially in the duramen and parallel to the longitudinal axis of the strips and by ensuring that the side thus formed is devoided of flash. That is to say the axis defining the cutting line is located in the plane top surface. The second cutting is made at a position $X_1$, equivalent in the pattern to $X_o$, and located at a distance $D_1$ from $X_O$ corresponding to the desired width of the strip. This second cutting is also made substantially in the duramen. The lateral joints are located at a position $X_J$ located at a distance $D_J$ from $X_O$. The first strip is thus obtained. The third cutting is then made at the distance $D_1$ from $X_1$ to obtain the second strip. Additional cuttings, always at a distance $D_1$ from the last cut, enables one tp obtain a series of identical strips using the same panel.

The cutting of the panels into strips is programmed in such a way that the lateral joints of the strips that will be adjacent in the beam will be out of line once the beam is assembled. To achieve this, the first planks of identical panels are cut at a position $X_O$ that differs for each panel. The lateral joints of the different panels are thus located at positions $X_J$ that differ relative to the sides of the strips. The strips from the different panels are then assembled into beams in which the lateral joints of adjacent strips are out of line.

The assembly of the planks in panels allows an optimum use of the presses and thus considerably reduces the time required for this manufacturing step.

This technique for the assembly of strips with planks of pre-selected width into panels that are subsequently cut into strips allows, by the judicious choice of planks, the production of all beam widths sold on the market using a limited number of plank width. This aspect of the invention is illustrated in Example 2 described below.

According to yet another aspect of the invention the width of the beams is a multiple of the desired width. The assembly of these beams is programmed to allow their longitudinal cutting in such a way as to obtain two or more beams of the desired width and that the new sides thus generated exhibit a substantially plane surface essentially made of the duramen. Thus, the cutting of the beam into two or more beams is accomplished without calling near or in the lateral joints to avoid discovering flash.

The invention is also directed at a method of making strips with dispersed finger joints using the beams assembled according to the above described method.

Figure 8:
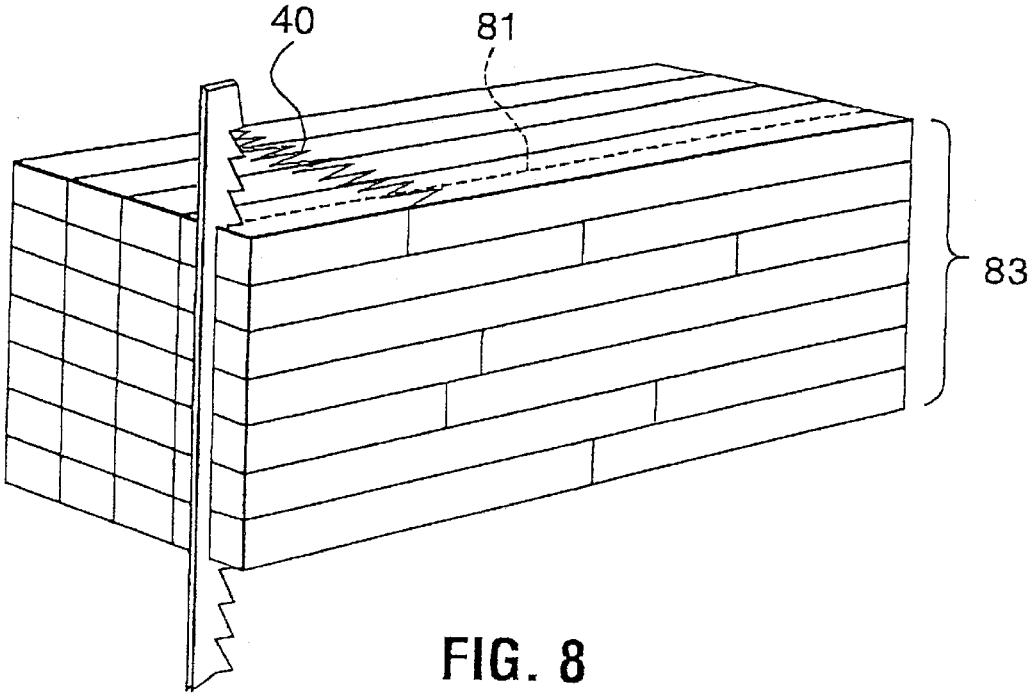
FIG. 8 is a perspective view illustrating the method for obtaining strips width of dispersed finger joints.
Figure 9:
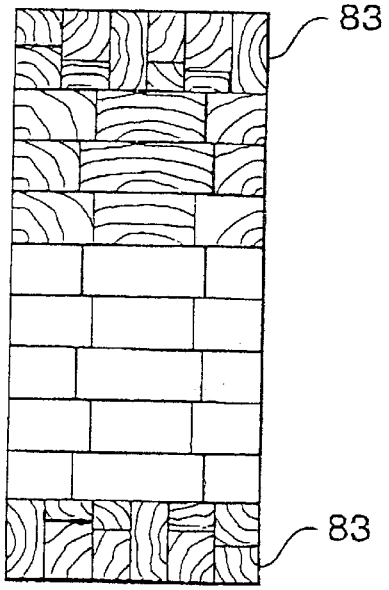
FIG. 9 is a sectional view of a beam comprising strips in which the strips forming the top and bottom of the beams are strips with dispersed finger joints.

As illustrated in FIG. 8, it is possible to obtain strips with dispersed finger joints using beams assembled according to the method of the instant invention. The beam is cut along a longitudinal axis 81 perpendicular to the finger joints 40 and in such a way that the axis defining the cutting line does not coincide with the lateral joints. There is thus obtained a strip 83 with dispersed finger joints. The strips can be used to form the top and bottom of beams of the instant invention and to provide an increased mechanical stability to beams that are constituted by strips having non dispersed finger joints.

DESCRIPTION OF PREFERRED EMBODIMENT

The present invention will be further illustrated in the following examples. However, it is to be understood that these examples are for illustrative purposes only, and should not be used to limit the scope of the present invention in any manner.

EXAMPLE 1

Precomposition of individual strips panels

A. Individual strips

A strip of a width of twelve inches (273 mm) may be obtained by assembling three planks with three two by four (2"×4") planks. The sides of the two planks located at the lateral ends of the strips form sharp edges (devoided of flash) with the top and the bottom of the planks.

Panels

A width of thirteen inches (289 mm) may be obtained by assembling planks into panels that are then cut at the appropriate position. For example, the panel may be composed of one 2"×4" plank, three 2"×3" planks, etc. The cutting of the panel into strips is accomplished by cutting the 2"×4": planks at a position $X_0$ and $X_1$ according to the method described above to obtain a strip with a width of thirteen inches.

EXAMPLE 2

Assembly of beams of various width using planks of various width

The following table presents the width of beams that can be obtained using strips comprising 2"×3", 2"×4" and 2"×6" planks. The table also contains information on the loss of material during the manufacture of the beams. Also shown is the ratio of original wood material necessary to produce one meter cubed of finished products as well as the width of beams available on the market.

TABLE

| beam dimension (inches) available commercially | beam dimension (inches and mm) of the instant invention | | Recurring of beams | Lost of material ($m^3$ finished product for 1 $m^3$ of starting material) Length | Cutting | Planing | Finished product ratio starting material ($m^3$ starting material for 1 $m^3$ finished product |
|---|---|---|---|---|---|---|---|
| 2½ | 2⅛ | 54 MM | ¼ strip B | 0.9 | 0.685 | 0.948 | 1.711 |
| 3 | | | | | | | |
| 3⅛ | 3⅛ | 79.3 MM | ⅓ strip A | 0.9 | 0.75 | 0.953 | 1.555 |
| 3½ | 3½ | 88.9 MM | ⅓ strip E | 0.9 | 0.785 | 0.959 | 1.555 |
| 4⅛ | | 105 MM | strip D | | | | |
| 5 | 4⅞ | 122.5 MM | ½ strip B | 0.9 | 0.778 | 0.96 | 1.488 |
| 5⅛ | | | | | | | |
| | 5¼ | 134 MM | ½ strip C | 0.9 | 0.785 | 0.967 | 1.464 |
| 5½ | 5½ | 139.7 MM | ½ strip E | 0.9 | 0.785 | 0.967 | 1.464 |

TABLE-continued

| beam dimension (inches) available commercially | beam dimension (inches and mm) of the instant invention | | Recurring of beams | Lost of material ($m^3$ finished product for 1 $m^3$ of starting material) Length | Cutting | Planing | Finished product ratio starting material ($m^3$ starting material for 1 $m^3$ finished product |
|---|---|---|---|---|---|---|---|
| 6¾ | 6⅝ | 170 MM | ⅔ strip A | 0.9 | 0.807 | 0.97 | 1.419 |
| 7¼ | 7½ | 190 MM | ¾ strip B | 0.9 | 0.807 | 0.971 | 1.418 |
| 8¾ | | | | | | | |
| | 10 | 256 MM | strip B | 0.9 | 0.816 | 0.965 | 1.411 |
| 10¾ | 10¼ | 261 MM | strip A | 0.9 | 0.826 | 0.965 | 1.394 |
| | 11 | 280 MM | strip C | 0.9 | 0.823 | 0.965 | 1.399 |
| | $11^{12/16}$ | 300 MM | strip E | 0.9 | 0.826 | 0.965 | 1.394 |

From the table, it can be seen that:
Strip A can be obtained using three 2" × 4" planks.
Strip B is four 2" × 3" planks.
Strip C is three 2" × 3" and one 2" × 4" planks.
Strip D is (hypothetical) 2" × 3.5" planks.
Strip E is one 2" × 3", one 2" × 6" and one 2" × 4" planks.

From the table, it can be seen that:

Strip A can be obtained using three 2"×4" planks,

Strip B is four 2"×3" plank.

Strip C is three 2"×3" and one 2"×4" planks.

Strip D is hypothetical) 2"×3.5" planks,

Strip E is one 2"×3", one 2"×6" and one 2"×4" planks,

Thus, according to the table, a beam having a width of ten inches may be manufactured using Strip B (the difference in the width between strip B (12") and the width of the finished beam is due to the cutting of the sides of the strip, and the planing). In addition, the beam made using Strip B may be cut into ¾–¼ to form two beams having a width of 7½ inches and 2⅛ inches respectively. At this step additional wood is lost by the cutting of the beam. The dimension that can be obtained using the method of the instant invention are not limited to the dimension reported in the table. Any combination of plank width and beam cuing that can yield a beam compatible with the above described beam is considered to be included within the scope of the instant invention.

EXAMPLE 3

Examples of beams comprising flash according to the instant invention

The models of beams described below will be better understood by referring to FIGS. 10–15.

Figure 10:
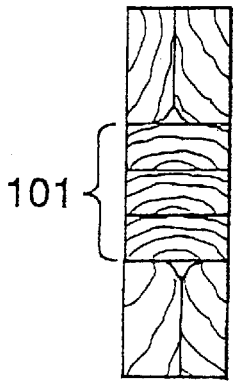
FIGS. 10–15 are sectional views of wood beams of the instant invention illustrating possible organization of the planks and strips within the beam.

A. In the beam of FIG. 10, the central part 101 comprises individual squared planks having a width equal to the width of the strip of the top and bottom strips of the beam.

Figure 11:
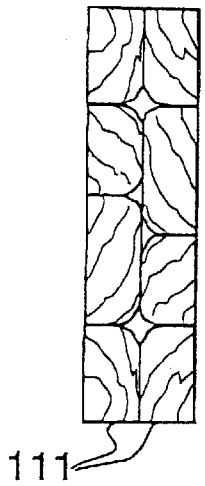

B. The beam of FIG. 11 is formed by two strips 111 vertically adhered and in which the lateral joints of the central part are out of line.

Figure 12:
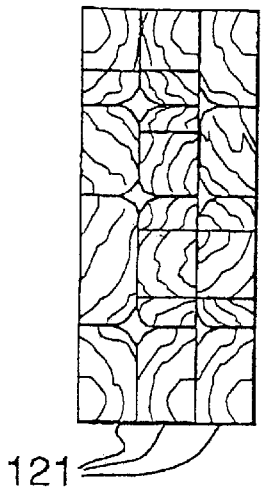

C. The beam illustrated in FIG. 12 is composed of three strips 121 vertically adhered and in which the later joints of the central part are substantially co-linear.

Figure 13:
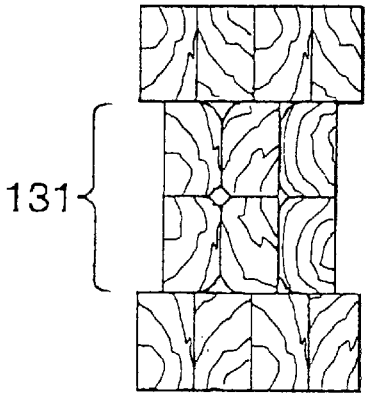
Figure 14:
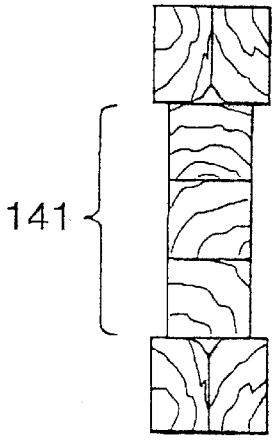
Figure 15A:
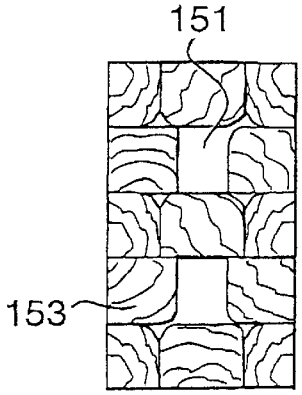
Figure 15B:
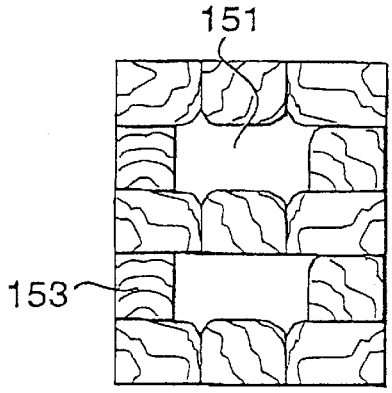
Figure 15C:
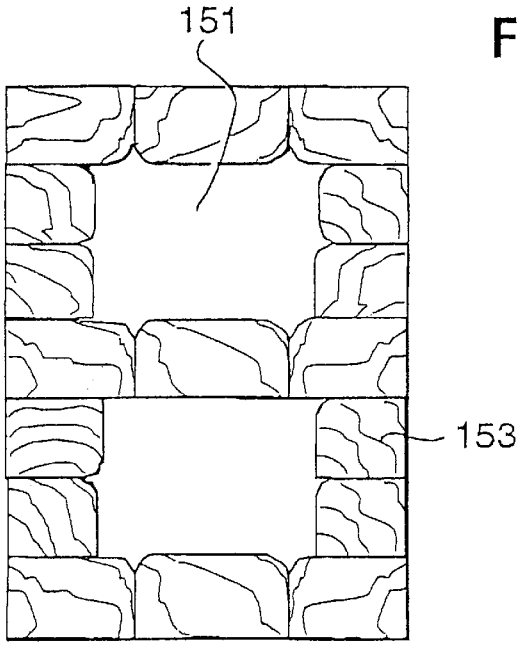

D. The beam illustrated in FIG. 13 is composed of three strips 131 vertically adhered and in which the lateral joints forming the central part are co-linear. The top and the bottom part of the beam are formed by strips devoided of flash and being optionally reinforced with fiberglass, carbon or airmide bands. In addition, the width of the central part is smaller than the bottom and top strips of the beam.

E. In the beam illustrated in FIG. 14 the central part of the beam 141 is composed of individual squared planks having a width smaller than the width of the strips of the bottom and top strips of the beam.

F. The beam illustrated in FIG. 15 exhibits a central part with empty spaces 151 (not resulting from the presence of flash) between the strips which are separated by intercalated planks 153 between adjacent strips.

EXAMPLE 4

Example of a calculation reflecting the improvement in the yield of finished products due to the use of small diameter trunks To obtain two 2"×4" plans with four sharp edges without flash, it is necessary to use a trunk diameter of at least 130 mm. However, if 15 mm of flash is still rated, it is possible to use a trunk having a diameter of 110 mm.

Figure 16:
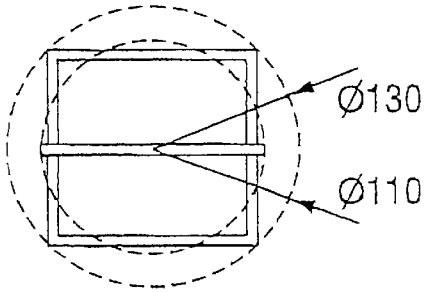
FIG. 16 is a schematic diagram representing the increased yield achievable by tolerating flash in the preparation of planks.

With reference to FIG. 16 and to the calculation shown below, an improved differential yield of 40% is calculated.

$$\frac{(130/2)^2 \times \pi}{(110/2)^2 \times \pi} = 1.396\ (40\%)$$

These examples illustrate the formation of beams using strips. However, the same beam may also be obtained by assembling individual planks appropriately selected. In addition, the beams described above are examples only. Any other model that would by obvious to a person skilled in the art is considered to be included within the scope of the invention.

What is claimed is:

1. A wood beam composed of rectangular strips, said strips comprising planks of identical length and having a width substantially smaller than the desired width of the beam, said beam being characterized by the presence of two strips forming the top and the bottom of said beam and a central part comprising either planks or strips, said beam being further characterized by the presence of flash in the interior and by the top, bottom and sides external surfaces being essentially plane.

2. The beam according to claim 1 wherein said plank are characterized by having two longitudinal plane surfaces substantially parallel constituting the top and the bottom of said plank and having two longitudinal plane surfaces constituting the sides of said planks, the sides being substantially perpendicular to the top surface and the bottom surface, the bottom surface intersect at a right angle each of the two sides, the top surface being linked to the sides by intersecting said sides at right angles or by the natural curvature of the trunk from which the plank is obtained thus forming flash, said strips being formed by two or more planks adhered by their sides thus forming lateral joints and in such a way that the bottom of the planks form a uniform plane surface and that the sides of the two planks at the lateral ends of the strips, non adjacent to another plank, intersect the top surface and the bottom surface at a right angle, the beam being formed by the assembly and reciprocal adherence of the strips, said beam being characterized by the presence in its interior of planks at least some of which exhibiting flash, said beam being also characterized by a top and a bottom each composed by a strip the bottom of which constituting the exterior of the beam, the strips included between the top strip and the bottom strip forming the central part, said beam being also characterized by two sides having a plane surface perpendicular to the top and bottom of the beam.

3. The beam according to claim 2 in which said external surfaces are made essentially of duramen.

4. The beam according to claim 3 in which the strips are superimposed horizontally.

5. The beam of claim 4 in which the lateral joins are substantially aligned according to one or more axis perpendicular to the width of the beam with the proviso that said lateral joints of adjacent strips are out of line relative to said one or more axis.

6. The beam according to claim 4 characterized by the presence of empty spaces, other than flash, obtained by intercalating plans between adjacent strips in such a way that the sides of the beam form a plane surface.

7. The beam according to claim 4 in which said strips are constituted by two or more strips jointed by their ends with finger joints to obtain strips having a desired length and said beam being assembled such that the finger joints of two adjacent strips are out of line.

8. The beam according to claim 7 wherein said finger joints are selected from: face jointing and flat jointing.

9. The beam according to claim 8 wherein said joints are face jointing.

10. The beam according to claim 9 wherein the top, bottom and sides surfaces are composed essentially of the hear of the wood.

11. The beam according to claim 10 wherein the planks are obtained from trunks of coniferous trees.

12. The beam according to claim 11 wherein the planks are obtained from black spruce trunks.

13. The beam according to claim 12 in which the planks have a thickness and a width selected from the following dimensions:

two inches by two inches (2"×2"), two inches by three inches (2"×3"), two inches by four inches (2"×4") and two inches by six inches (2×"6").

14. A method for making the beam according claim 4 comprising the steps of.

a) obtaining planks having two longitudinal plane surfaces substantially parallel constituting the top and the bottom of said plank and having two longitudinal plane surfaces constituting the sides of said planks, the sides being substantially perpendicular to the top and the bottom surface, the bottom surface making a right angle with each of the two sides, the top surface being linked to the sides by either a right angle or the natural curvature of the from which the plank is obtained thus forming flash;

b) drying the planks to obtain a hydrometric degree compatible with the application of an adhesive;

c) sorting the planks to eliminate those that do not conform with pre-established selection criteria selected from general geometry, absence of timber knots effecting the mechanical resistance of the planks and mechanical resistance properties;

d) treating the sides of the planks to optimize the efficiency of a selected adhesive;

e) selecting the planks sorted according to their width to assemble the strips having a length corresponding to the desired length of the beam;

f) applying the adhesive on said sides of the planks and placing the plans side by side in such a way that the sides are in reciprocal contact and that the bottom of the planks form a plane surface to constitute strips having a width equal to or greater than the desired width of the beam and applying a lateral pressure to optimize adhesion of the plank;

g) joining the strips by their ends to form finger joints;

h) applying an adhesive on the top surface of the strips; and i) assembling the strips to form a beam having the desired dimensions and applying pressure to optimize the adhesion of the strips.

15. The method according to claim 14 in which the sorted planks are classified in two groups according to their mechanical resistance.

16. The method of claim 14 in which the strips are horizontally superimposed.

17. The method according to claim 14 wherein said treatment is a planing of said sides.

18. The method according to claim 14 in which the planks in the strips differ in their width and are assembled in panels according to a repetitive pattern relative to their width, said panels being cut along the longitudinal axis of the planks to obtain strips of desired width, the cuttings being made such that the sides of the strips intersect the bottom and top surfaces of said planks at a right angle and that said sides are constituted essentially of the duramen of the wood.

19. The method according to claim 18 wherein the cutting of panels comprises the steps of:

a) cutting the first plank of a first panel at a position $X_O$ located at a disuse $D_O$ from the side of the plank;

b) cutting the panel at a position $X_1$, equivalent in the repetitive pattern to the position $X_O$, said position $X_1$ located at a distance $D_1$ from $X_O$ to form a strip with a width with $D_1$ and in which the lateral joints are located at a distance $X_J$ from $X_O$;

c) recutting the said panel at a distance $D_1$ from $X_1$; and d) repeat steps a) to c) for each strip.

20. The method according to claim 19 wherein said first plank is cut at a position $X_O'$ and said panel is then cut at a distance $X_1'$ with the proviso that the distance between $X_O'$ and $X_1'$ is equal to $D_1$.

21. A wood beam comprising strips obtained according to the method of claim 20.

22. A method to obtain wood beams of a desired width using the wood beam according to claim 21, the method comprising the longitudinal cutting of said beam such as to form two or more beams of desired width and that the new wood beam sides generated by the cutting exhibit a substantially plane surface and are essentially composed of wood from the duramen of the trunk.

23. A wood beam according to claim 4 wherein the width is a multiple of the desired width.

24. A method of manufacturing a strip having dispersed finger joints using the beam of claim 4 said strip being obtained by the longitudinal cutting of said beam to form a strip of the desired width.

25. A wood beam in which the bottom and top strips are prepared according to claim 24.

26. The beam of claim 3 in which the central part of the beam is composed of individual squared planks having a width equal to the width of the beam and top strips of the beam.

27. The beam of claim 3 formed by vertically adhered strips, the top and bottom of said beam being constituted by the sides of the strips and in which the lateral joints of the central part are out of line.

28. The beam of claim 3 formed by vertically adhered strips, the top and bottom of said beam being constituted by the sides of the strips and in which the lateral joints of the central part are substantially co-linear.

29. The beam of according to claim 3 in which the central part is constituted by vertically adhered strips and in which the lateral joints are co-linear, the bottom and top of said beam being formed by strips devoided of flash and characterized by the width of the central part being smaller than the width of the bottom and top strips of the beam.

30. The beam according to claim 3 in which the central part is composed of individually squared planks having a width smaller than the width of the top and bottom strips of the beam.

* * * * *